US008413914B2

(12) United States Patent
Davis

(10) Patent No.: US 8,413,914 B2
(45) Date of Patent: Apr. 9, 2013

(54) ELECTROSTATIC FAST-SET SPRAYABLE POLYMER SYSTEM AND PROCESS

(75) Inventors: Thomas Davis, Bay City, MI (US); Melissa Pena, legal representative, Stockridge, MI (US)

(73) Assignee: Hanson Group, LLC, Alpharetta, GA (US)

( * ) Notice: Subject to any disclaimer, the term of this patent is extended or adjusted under 35 U.S.C. 154(b) by 359 days.

(21) Appl. No.: 12/660,758

(22) Filed: Mar. 4, 2010

(65) Prior Publication Data

US 2011/0215165 A1 Sep. 8, 2011

(51) Int. Cl.

| | |
|---|---|
| ***B05B 5/053*** | (2006.01) |
| ***B05B 5/03*** | (2006.01) |
| ***B05B 5/025*** | (2006.01) |
| ***B05B 5/00*** | (2006.01) |

(52) U.S. Cl.
USPC ..... 239/690; 239/706; 239/708

(58) Field of Classification Search ..... 239/3, 690, 239/690.1, 691, 692, 704, 705, 706, 708, 239/526; 118/300, 310, 621, 629
See application file for complete search history.

(56) References Cited

U.S. PATENT DOCUMENTS

| | | | | |
|---|---|---|---|---|
| 3,323,934 | A | 6/1967 | Point | |
| 3,740,612 | A * | 6/1973 | Gauthier et al. | 361/227 |
| 3,864,603 | A * | 2/1975 | Kozinski et al. | 361/1 |
| 4,437,614 | A * | 3/1984 | Garcowski | 239/691 |
| 4,498,631 | A * | 2/1985 | Gourdine | 239/692 |
| 4,660,771 | A * | 4/1987 | Chabert et al. | 239/694 |
| 4,702,932 | A | 10/1987 | Cosentino | |
| 4,713,257 | A * | 12/1987 | Luttermoller | 427/483 |
| 5,056,720 | A | 10/1991 | Crum et al. | |
| 5,089,569 | A | 2/1992 | Yamamoto et al. | |
| 5,198,521 | A | 3/1993 | Ehrhart et al. | |
| 5,342,889 | A | 8/1994 | Sullivan et al. | |
| 5,405,090 | A | 4/1995 | Greene et al. | |
| 5,574,104 | A | 11/1996 | Kolycheck et al. | |
| 5,798,145 | A | 8/1998 | Barancyk et al. | |
| 6,032,871 | A | 3/2000 | Borner et al. | |
| 6,359,059 | B1 | 3/2002 | Shepler et al. | |
| 6,399,206 | B1 | 6/2002 | Carswell et al. | |
| 6,797,789 | B2 | 9/2004 | Davis | |
| 6,914,115 | B2 | 7/2005 | Spyrou et al. | |
| 7,041,374 | B1 | 5/2006 | Nelson et al. | |

* cited by examiner

*Primary Examiner* — Darren W Gorman
(74) *Attorney, Agent, or Firm* — Raggio & Dinnin, P.C.

(57) ABSTRACT

A method and apparatus for electrostatically spraying a plural component fast set polymer is disclosed. The system comprises a spray gun and at least two hoses connected to the head of the spray gun. The system also includes a proportioner connected to an end of the at least two hoses and a high voltage generator electrically and pneumatically in communication with the spray gun. The electrostatic spray system will allow for a fast set polymer to be imparted with electrical charge after mixing of a first and second component in a spray head thereof prior to expulsion via a nozzle to a grounded target that is being coated with the electrostatic spray coating.

14 Claims, 8 Drawing Sheets

ELECTROSTATIC FAST-SET SPRAYABLE POLYMER SYSTEM AND PROCESS

FIELD OF THE INVENTION

The present invention generally relates to electrostatic spray guns and more particularly relates to an electrostatic spray system for use in spraying plural component fast set polymers and a method thereof.

DESCRIPTION OF RELATED ART

It is well known in the art to coat or paint materials of construction, components of fabricated products and stand alone items to protect such objects from their environments. Many of these coating formulations use modern polymer chemistry such that advanced chemical combinations, types of solvent systems, waterborne systems, high solids, and 100% solid formulas provide a wider variety of finished products. Many additives impart a wide variety of processing, physical property and performance characteristics that further enhance the capabilities of the numerous coatings available. In the prior art many of these coatings use manual application techniques to apply the coatings for residential construction, repainting surfaces and many projects that are not high volume production. Some of these applications even use brushes and roller applications or the like. The prior art also has high volume production application equipment and techniques that may include efficient hand held air system airless spray guns that apply uniform and smooth coatings to an object. Also, in the prior art some computer controlled robotic distribution systems distribute paint onto large bodies such as automobile bodies and other high production items. The prior art may also include dip coating and e-coat priming techniques for high volume installations. The spray type application methods as described above in the prior art generally are capable of producing very high quality surface finishes, uniform thicknesses and reproducibility.

However, many prior art spray methods for coating may suffer from various degrees of loss of coating due to blowing past the target surface and being wasted. The percentage of coating that does successfully remain on the desired target is sometimes known as transfer efficiency in the prior art. The transfer efficiency of some of these applications can be as low as zero percentage, such as when coating wire fencing and other targets have a very low ratio of solid surface to open surface. On the other hand, transfer efficiency may be substantial for some applications and methods even up to a 90% range. The prior art includes an electrostatic spraying method. This type of spraying occurs where the target that needs to be coated has to be conductive, such as steel and also must be grounded. The coating that is dispensed is charged with a significant negative charge as it exits from a spraying apparatus. The opposite charges will attract and the coating is then drawn toward the target. Each reaction is so strong that the coating in a properly set up operation will actually wrap around and cover the back surface of the target. Furthermore, the coating may be attracted to interior surfaces or irregularities of the target in some instances such as difficult to reach areas, which generally may not regularly be coated as well. Many of these prior art electrostatic spray systems use single components liquids that are slow cure systems that are applied with the electrostatic process. Many of these prior art systems are solvent based and are highly limited in their use by environmental regulations due to VOC's and other safety issues. It should be noted that there is an aggressive movement to eliminate such single component liquids from use in many countries.

Still another prior art electrostatic spray system uses a water based liquid which generally are not effected by environmental regulations but are very slow drying. Curing in these systems generally requires extended high temperature cycles that involve ovens, significant energy consumption and the processing of hot products all resulting in high costs and very slow processing of the systems. Another prior art electrostatic spray technique is powdered coating. In this technique a very finely divided powder, commonly an epoxy formulation, is charged in the spray gun and deliver to an oppositively charged target. The powder adheres generally well to the target objects so that it will remain in place and can be delivered into a high temperature oven operating at about 400° F. Powder coats typically require about ten to fifteen minutes of the elevated temperature to melt the powder and cure the polymer. As with water borne coatings, powder coatings require high temperature cure for extended periods of time, resulting in high energy costs to generate the heat, extended processing cycles and operator safety considerations handling hot products. Therefore, there clearly is a need in the art for an improved electrostatic spray system that uses a fast set polymer and method of delivering the same to a target.

There also is a need in the art for an electrostatic fast set polymer spray system that uses plural components to create a fast set polymer.

There also is another need in the art for an electrostatic spray system that is capable of electrostatically spraying material that is capable of becoming solid and dry within twenty seconds and dry to the touch in thirty to forty five seconds.

There also is a need in the art for a low cost easy to apply electrostatic spray method that cures quickly and allows for shorter down times of the target objects being coated.

SUMMARY OF THE INVENTION

One object of the present invention may be to provide an improved electrostatic spray system.

Another object of the present invention may be to provide an improved method of electrostatic spraying.

Still another object of the present invention may be to provide an electrostatic spray system that uses a fast set polymer comprised of plural components.

Still another object of the present invention may be to provide an electrostatic spray system that is capable of gelling to a solid in four to twenty seconds and being dry to the touch in thirty to forty seconds after application thereof.

Still another object of the present invention may be to provide an electrostatic spray gun controlled by a pneumatic pressure signal to active high voltage circuitry thereto.

Still another object of the present invention may be to provide an electrostatic spray system with a spray gun that imports charge to at least two materials passing through a spray head in order to create a negatively charged, blended and reacting material to be sprayed onto a grounded target.

Still another object of the present invention may be to provide for fast bleeding of charge to the gun upon release of a spray trigger thus neutralizing the gun and eliminating any lingering high voltage therein.

Yet another object of the present invention may be to provide an electrostatic spray gun that has an electrical insulator arranged between the spray head and a handle.

Still another object of the present invention may be to provide an electrostatic spray system that includes an insulated spray gun, at least two hoses connected between a proportioner and the spray gun and at least two hoses connected between a proportioner and a first feed receptacle and a second feed receptacle for the components needed to form the fast set polymer.

To achieve the foregoing objects, an electrostatic spray system for spraying a plural component fast set polymer is disclosed. This system includes a spray gun and at least two hoses connected to a head of the spray gun. The system also includes a proportioner connected to an end of the two hoses and a high voltage generator electrically and pneumatically in communication with the spray gun.

One advantage of the present invention may be that it provides an improved electrostatic spray system.

Still another advantage of the present invention may be that it provides an improved method of spraying a fast set polymer through an electrostatic spray system.

Yet another advantage of the present invention may be that it is capable of spraying a fast set polymer that gels to a solid in four to twenty seconds and is dry to the touch in thirty to forty five seconds.

Yet another advantage of the present invention may be that it provides an electrostatic spray system that includes a spray gun having an electrical insulator arranged between a spray head and a handle thereof.

Still another advantage of the present invention may be that the electrostatic spray system includes an insulated spray gun electrically and pneumatically connected to a high voltage generator.

Still another advantage of the present invention may be that it provides an electrostatic spray system wherein the spray gun is connected via hoses to a proportioner that is connected to at least a first and second feed receptacle holding at least two components for a plural component fast set polymer.

Still another advantage of the present invention may be that it provides an electrostatic spray system that uses a fast set plural component polymer that has a suitable resistance to accept an electrical charge enabling it to be sprayed in an electrostatic process.

Still another advantage of the present invention may be that it provides an electrostatic spray system that allows for fast set coatings having a uniform thickness, excellent physical properties and exceptional performance characteristics.

Still another advantage of the present invention may be that it provides a rapid set and cure time system that speeds up the process of electrostatic spraying.

Yet another advantage of the present invention may be that it eliminates the need for a heat cure cycle which will eliminate oven equipment costs, substantial utility consumption and space requirements.

Other objects, features and advantages of the present invention will become apparent from the subsequent description and the appended claims, taken in conjunction with the accompanying drawings.

DESCRIPTION OF THE EMBODIMENT(S)

Figure 1:
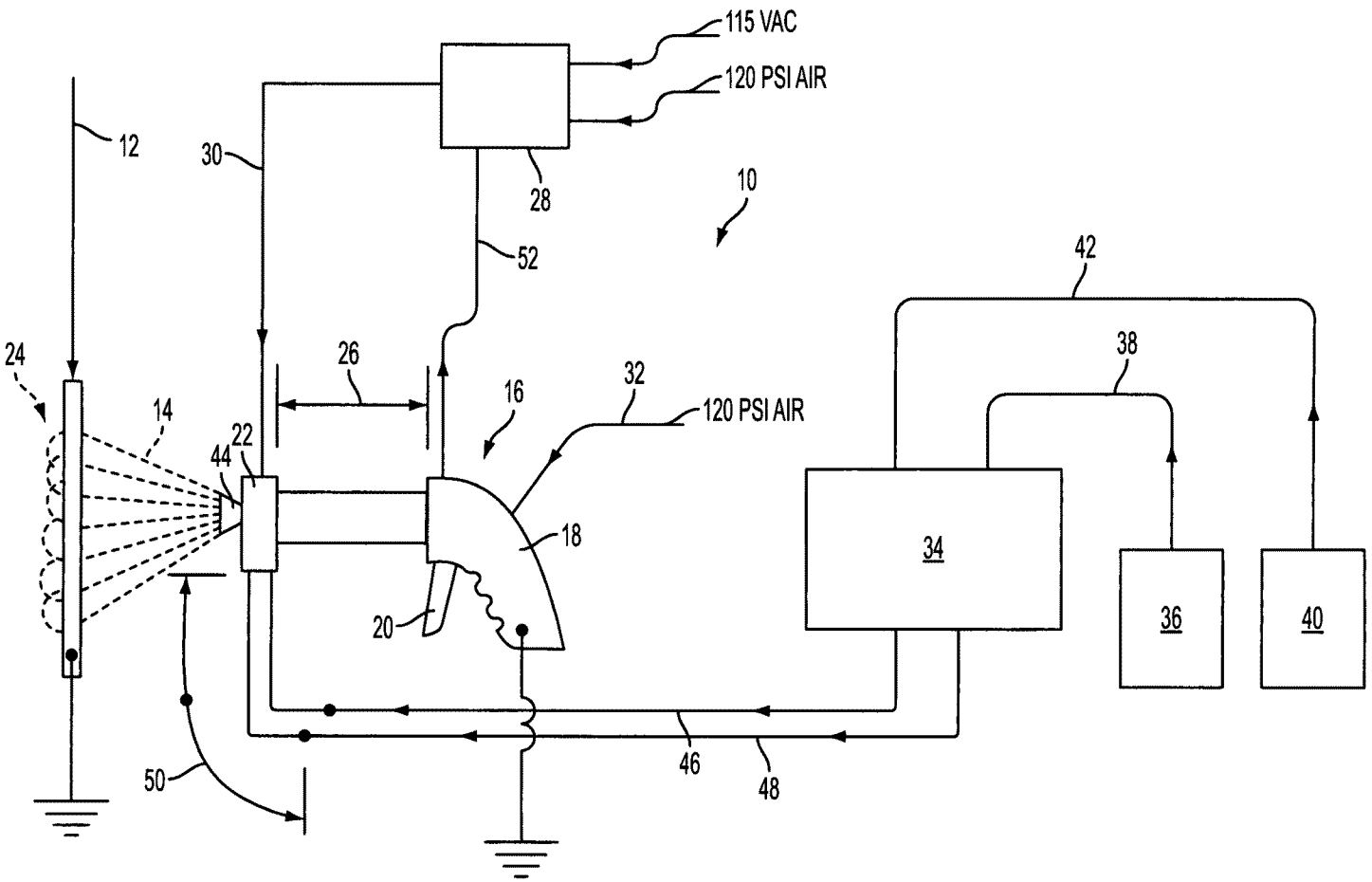
FIG. 1 shows an electrostatic spray system according to the present invention.
Figure 2:
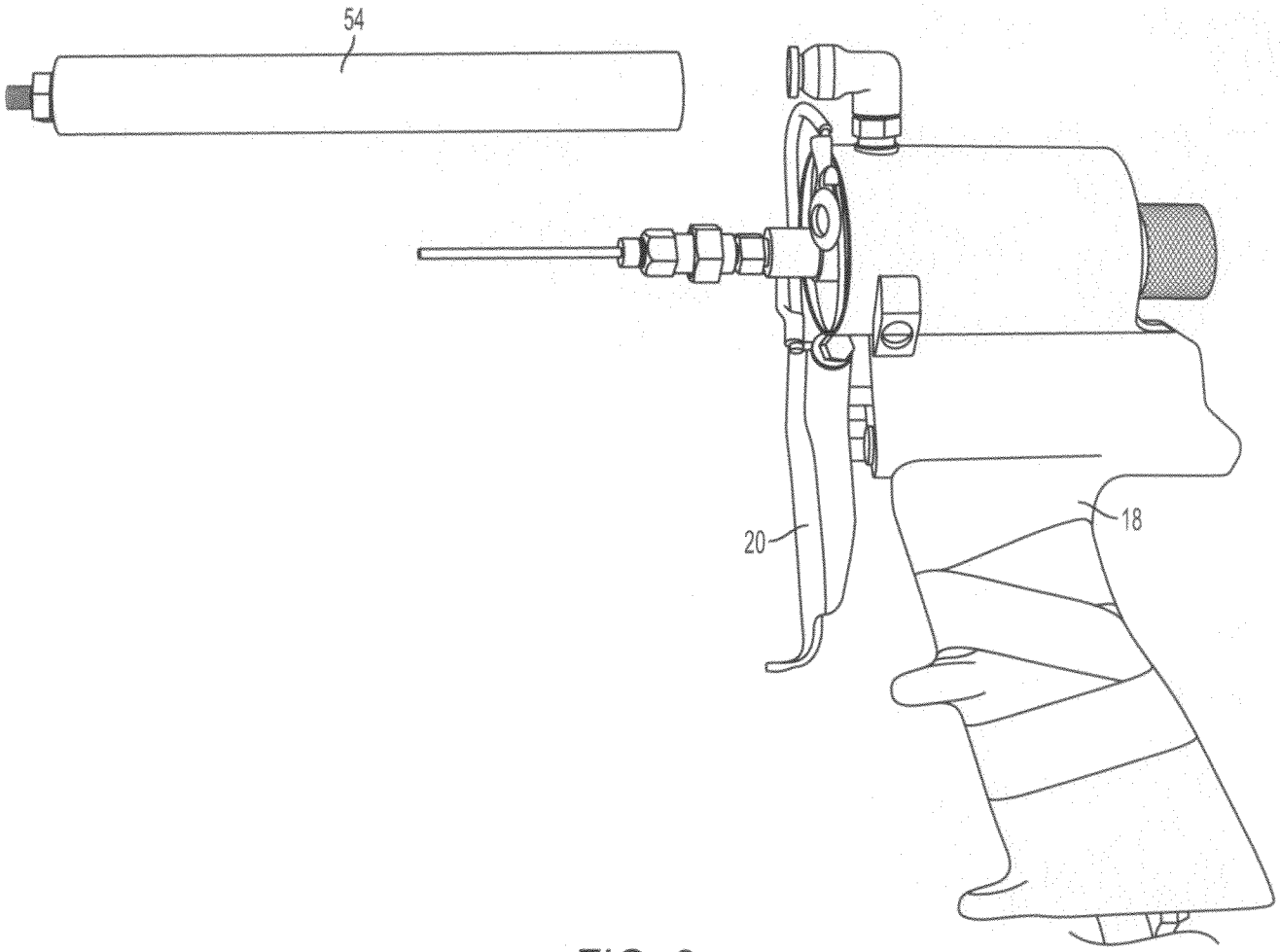
FIG. 2 shows a spray gun for use with the electrostatic spray system according to the present invention.
Figure 3:
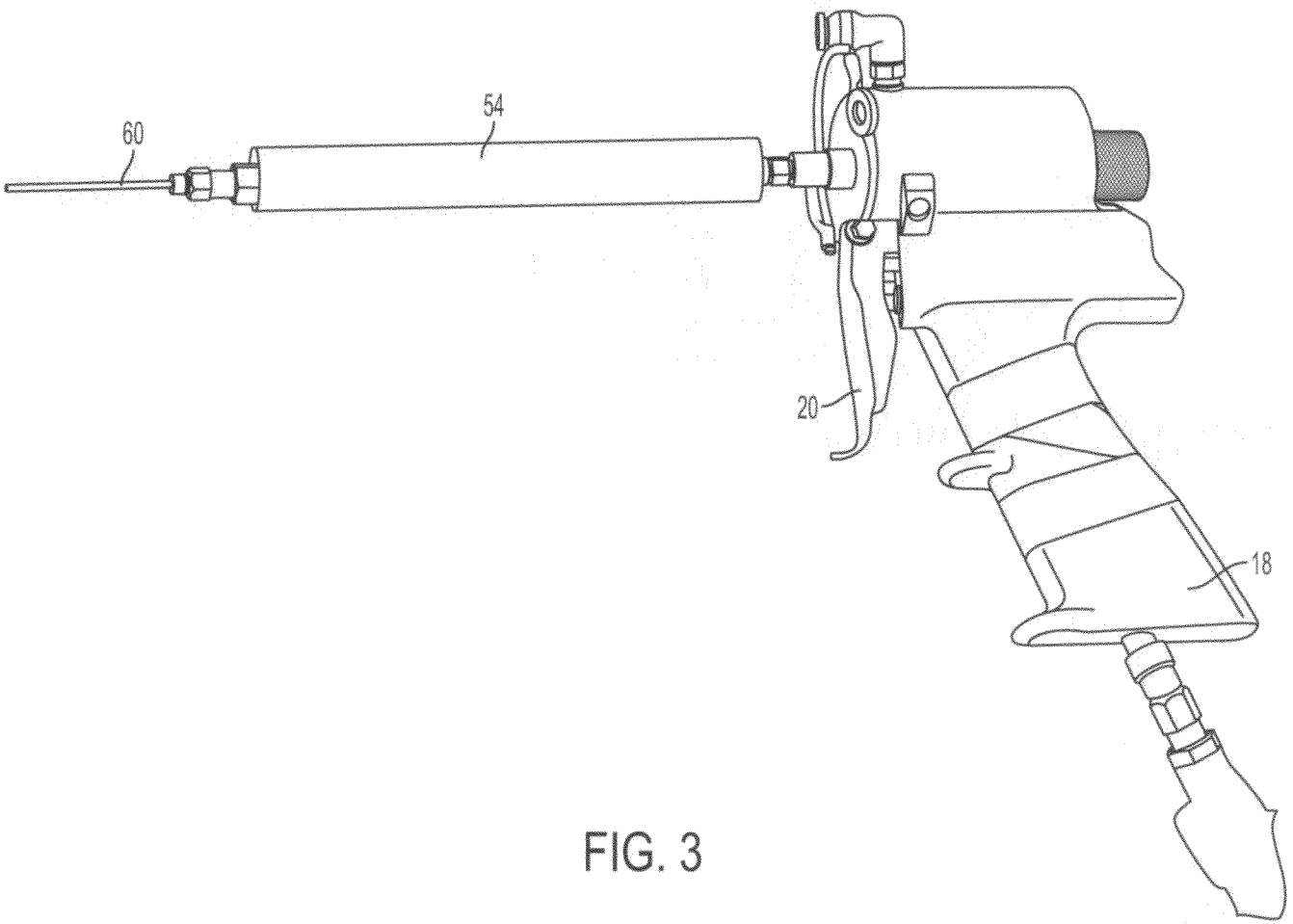
FIG. 3 shows a spray gun according to the present invention with the valving rod mounted on an insulator/spacer.
Figure 4:
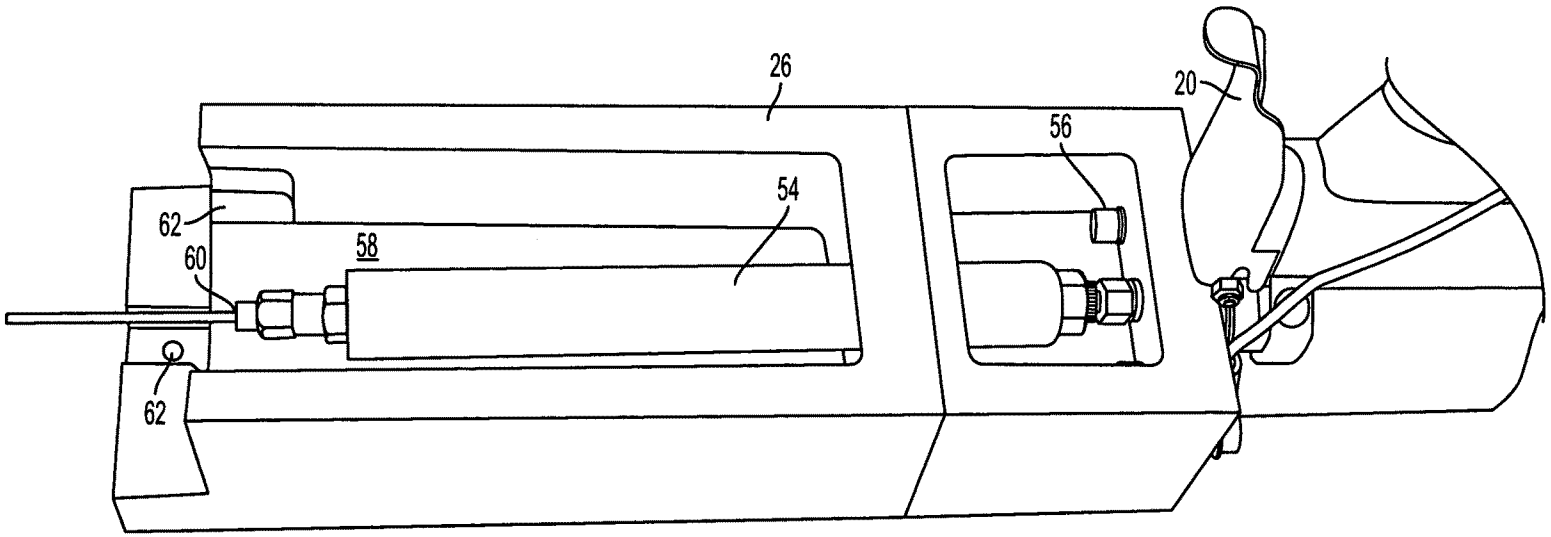
FIG. 4 shows a spray gun according to the present invention with the spray head mounting insulation member attached thereto.
Figure 5:
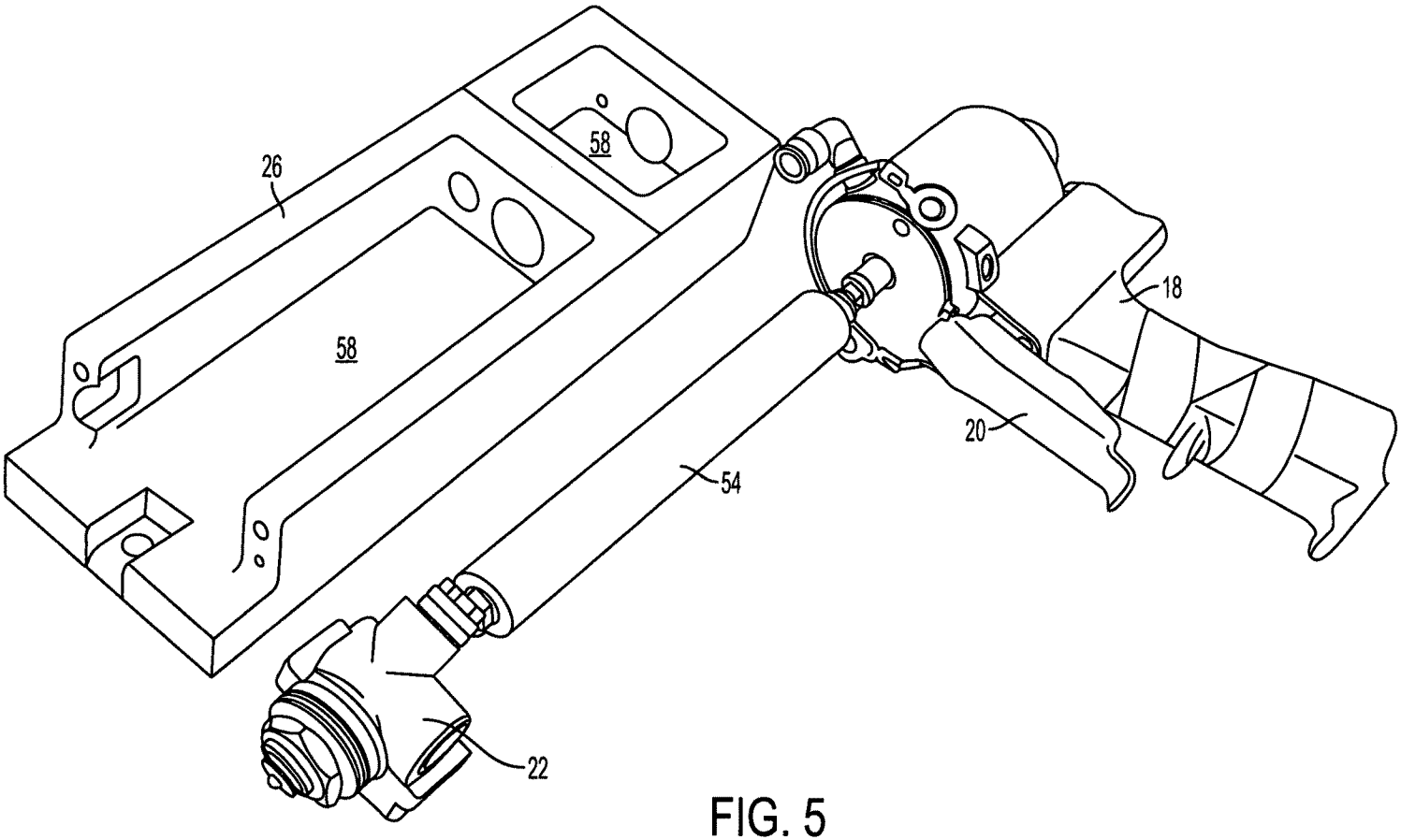
FIG. 5 shows a spray head attached to the insulation or insulator member according to the present invention.
Figure 6:
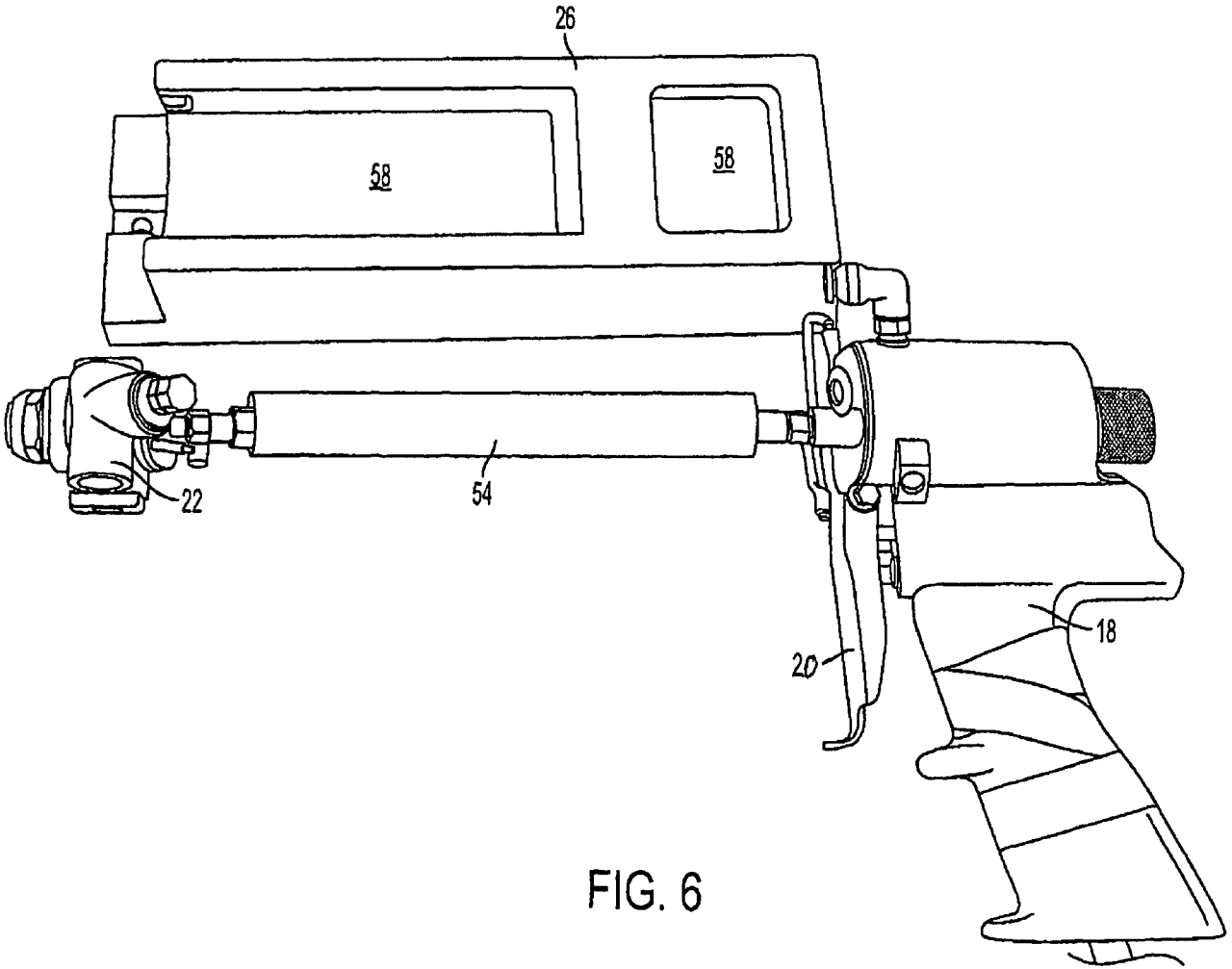
FIG. 6 shows a side view of the spray gun with the spray head mounted to the insulation member according to the present invention.
Figure 7:
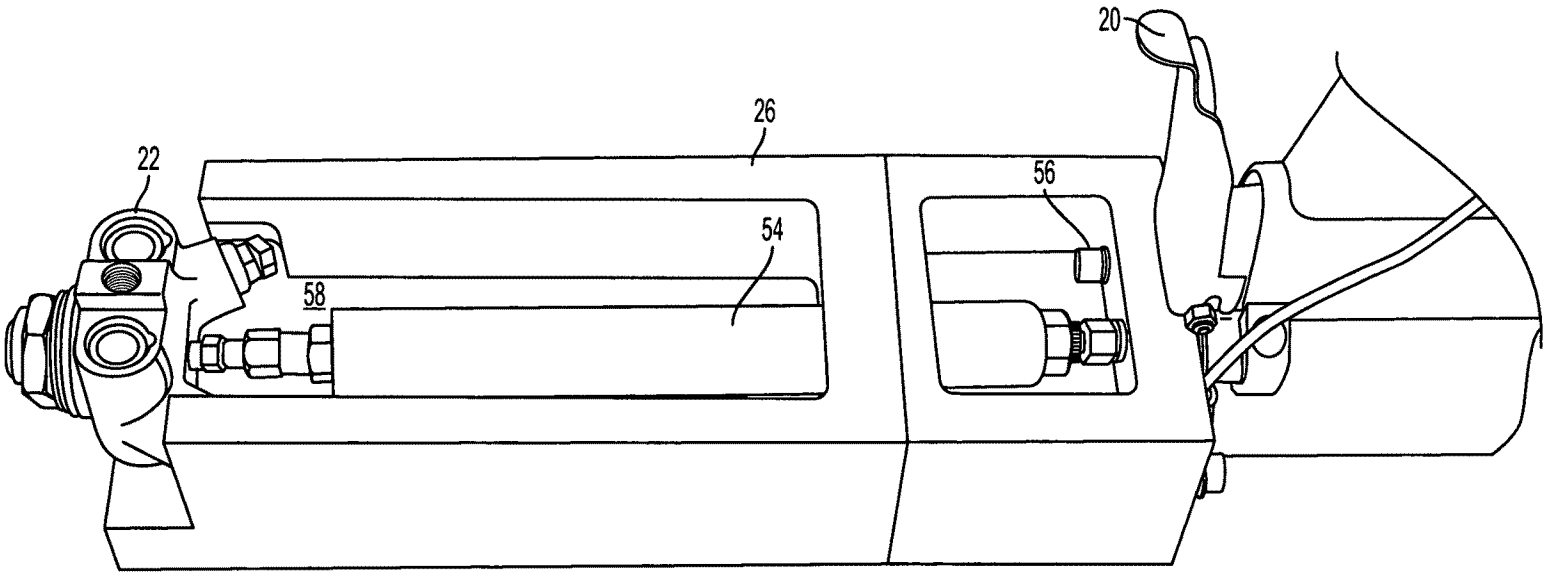
FIG. 7 shows the spray gun according to the present invention viewed from an underside.
Figure 8:
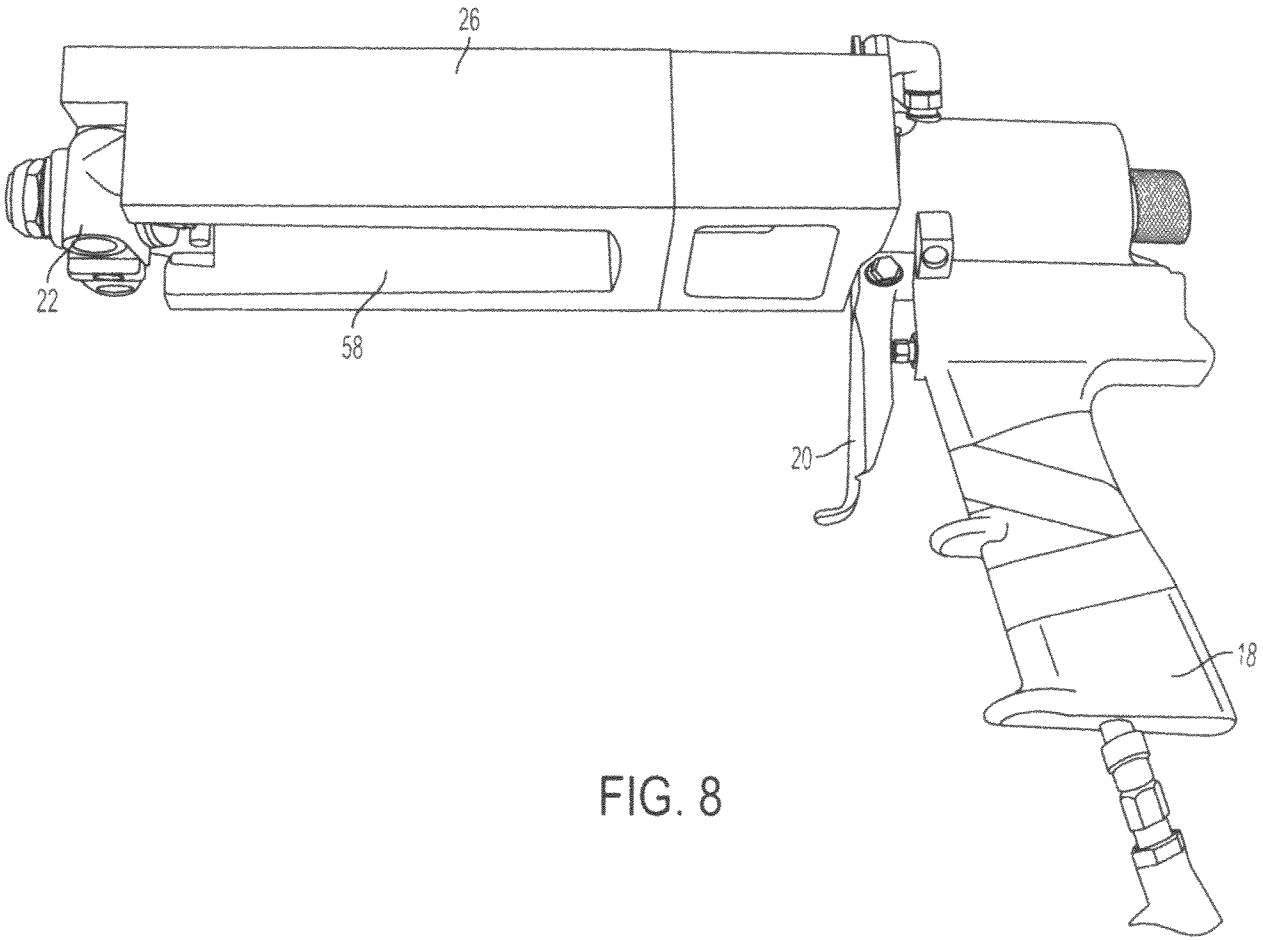
FIG. 8 shows a spray gun for use with the electrostatic spray system according to the present invention.

Referring to the drawings, an electrostatic spray system 10 and method according to the present invention is shown. The present invention includes an electrostatic spraying system 10 that uses specific materials, equipment and methods to spray/apply fast setting plural component liquid polymers to substrates or targets 12 that are suitable for grounding so that they are effectively and efficiently coated with the charged particles that are dispensed from the spraying apparatus. Typically, electrostatically applied coatings have the advantage of back side "wrapping" and have uniform coating thickness over the target member 12. The electrostatic spray system 10 of the present invention uses predetermined types of fast set plural component polymer materials 14 that are formulated to have a suitable resistance such that the materials 14 will accept an electrical charge enabling the materials 14 to be sprayed effectively by the electrostatic process. Spraying correctly formulated fast set polymers through properly designed and installed equipment results in fast setting coatings that have uniform thickness, excellent physical properties and exceptional performance characteristics. Furthermore, the electrostatic spray system 10 also protects personnel using the system against shock and other electrical related occurrences. The present invention has many advantages over prior art processes including, but not limited to, the rapid set and cure times of the gels/materials 14 speed up the process of electrostatic coating. Furthermore, the elimination of the heat cure cycle will eliminate oven equipment costs, substantial utility consumption costs and space requirement necessary for large ovens to bake items being coated as in the prior art.

The electrostatic spraying system 10 of the present invention is for use with fast set plural component coatings 14 and will be dispensed through in one embodiment a self cleaning impingement spray gun 16. In one embodiment a GRACO/Gusher GX7-400 or GX-8 model may be used. However, it should be noted that any other self cleaning impingement spray gun 16 may be used in accordance with the present invention. The spray gun 16 generally may include a handle 18 and a trigger 20 arranged therein. The spray gun 16 also may include a spray head 22 that has all of the necessary ports and nozzles necessary to mix a plural component material 14 prior to discharge from the spray head 22 into a predetermined spray pattern 24. The spray gun 16 also may include an electrical insulator member 26 arranged between the spray head 22 and a handle 18 of the spray gun 16. It should be noted that the spray gun 16 and all components therein may be made of any known material, including but not limited to metal, plastic, composite, natural materials, rubber, etc. The electrostatic spraying system 10 also includes a high voltage generator 28 that is capable of producing and sending high voltage, i.e., up to approximately 90 k V DC, via a conductor 30 to the spray gun spray head 22. The conductor 30 can be made of any known conductive material that is capable of transferring up to 90 k volts as discussed below. The spray gun also is connected to a pneumatic apparatus pump 32 that is capable of providing approximately 120 psi of air pressure to the spray gun 16 to allow for proper operation and spraying of the plural component material 14 from the pneumatically operated spray gun 16.

The electrostatic spray system 10 also includes a proportioner 34, wherein a first component 36 of the spray material 14 is connected thereto via a hose 38 and a second component 40 of the spray material 14 is connected thereto via a base 42 as shown in FIG. 1. However, it should be noted that the plural component spray material 14 can have more than two components but two components are just shown in the embodiment of FIG. 1. The proportioner 34 will allow for the precise and necessary amount of each of the first and second materials to be sent the spray head 22 of the spray gun 16 to allow for proper mixing of each of the components 36, 40 in the spray head 22 prior to expulsion from the spray head nozzle 44 onto the target 12 being coated. The proportioner 34 is connected to the spray head 22 of the spray gun 16 via high pressure hoses 46, 48 that are capable of operating at pressures of up to 3000 psi each. It should also be noted that a predetermined amount of the end 50 of the hoses 46, 48 connected to the spray head 22 will be made of a non-conducting material. In one, embodiment approximately the last two feet of the hoses 46, 48 will be non-conductive thus protecting the proportioner 34 and any other workers nearby from any electrical shock. It should be noted that the hoses 46, 48 can be made of any known material including but not limited to rubber, composite, metal, natural materials, or the like, this is for all of the hoses arranged between the proportioner 34 and the spray head 22 of the gun 16 and the proportioner 34 and the material storage devices holding the first and second components 36, 40 separately therein. Any known type of compression/pump device 32 may be used to provide the 120 psi of air pressure necessary for the spray gun 16 to operate according to the present invention. It should be noted that one portion of the 120 psi may be attached to a predetermined part of the handle 18 to provide for the necessary pressure to allow for a spraying pattern to exit the spray head 22 in a predetermined manner. While another pneumatic line/conduit 52 is connected to a compressor system that will allow for the turning on and off of the high voltage generator 28 and electrical flow to the spray head 22 from the high voltage generator 28.

Generally, the first and second components 36, 40 of the material will feed through the proportioner 34 and flow through the first and second high pressure hoses 46, 48 to the spray head 22 of the spray gun 16. It should be noted that the material is dead headed at the closed ports at the spray head 22 of the spray gun 16. As noted above the pneumatic pressure is supplied to the spray gun 16 at approximately 120 psi, however it should be noted that any other pressure may be used depending on the design requirements of the electrostatic spray gun 16 and the plural component materials 36, 40 being sprayed therefrom. As discussed above, the spray gun 16 will have a trigger 20 arranged within the handle 18 that allows for the commencement of spraying such that two changes will take place simultaneously upon pulling of the trigger 20. The first is that the material ports, in the embodiment envisioned there are two material ports any other number of material ports may also be used, in the spray gun 16 will open and the spray pattern 24 will start emanating from the end of the nozzle 44 of the spray head 22. Second, a pneumatic pressure signal will be sent from the "open" or triggered spray gun 16, i.e., a spray gun 16 that has started spraying, through a conduit 52 under pneumatic pressure to a high voltage generator 28 via the pneumatic conduit 52. This pneumatic pressure signal will in turn activate the high voltage circuitry of the high voltage generator 28 which in turn will send a high voltage along the electrically conductive conductor 30 arranged between the high voltage generator 28 and the spray head 22 of the spray gun 16 which will in turn impart or transfer charge to the material 14 passing through the spray head 22. It should be noted that the voltage sent to the spray head 22 is approximately up to 75,000 VDC, however it should be noted that any other high voltage may be used and in one contemplated embodiment approximately 50,000 VDC having less than 100 micro amps may be used. It should be noted that imparting the charge to the material 14 via the spray head 22 will allow the negatively charged, blended and reacting material 14 to be sprayed and attracted to the grounded target 12 upon which the coating is being placed thereon. It should be noted that the target 12 must be grounded to ensure that the negatively charged, blended and reacting plural component fast set polymer 14 is in fact attracted to the target 12 to be coated with the material 14. It should be noted that after the user of the electrostatic spray gun 16 releases the trigger 20 the material ports in the spray head 22 will close, thus stopping the spray from emanating from the end of the spray head 22 via the nozzle 14 and will in turn re-isolate the first and second materials 36, 40 from each other thus stopping the reaction and blending of the materials. Also, generally simultaneously upon releasing of the spray gun trigger 20 the positive or active pneumatic signal to the voltage generator 28 will be stopped thus stopping any voltage from flowing between the high voltage generator 28 and the spray head 22, thus leading to bleeding off rapidly of any residual voltage. This will ensure that the high voltage at the gun 16 is neutralized in fractions of a second, thus eliminating any lingering high voltage danger to personnel in the area of the electrostatic spray gun system 10.

It should be noted that the electrostatic spray gun 16 according to the electrostatic spray system 10 of the present invention includes all of the necessary ports, nozzles, pins, seals, connectors and pivot mechanisms necessary to have the gun 16 operate as described above in the electrostatic multi fast set polymer spray environment.

The electrostatic spray system 10 of the present invention uses a very high voltage with a very low amperage to charge the material 14 at the spray head 22 of the spray gun 16. In one contemplated example a 50,000 VDC with less than 100 micro amps voltage may be used. It should be noted that any voltage up to 90,000 VDC in any known amperage may be used depending on the design requirements of the system. The wetted portion of the gun 16 is the portion that will be charged. The potential is transferred to the material 14 as it passes through the gun passages in the spray head 22 of the spray gun 16. This charge needs to be totally electrically isolated from all surroundings and mountings for safety and to protect against unwanted power drain thus affecting the chargeability of the material 14 being sprayed. It should be noted that such spray guns as those described above may be mounted on rigid pre-positioned arms or on moving robots. It should further be noted that extreme care must be taken in the set up and design so that there is no electric bleed from the gun 16 into the mounting brackets, backwards through the material feed hoses 46, 48 and air supply hose or any actuating device used to trigger the spray gun 16. It should further be noted that in the present invention all of the brackets and fixtures generally are non-conductive and made of a material that is non-conductive such as but not limited to high density polyethylene. All hoses should also be but are not required to be of non-conductive construction to ensure no bleed from the spray head 22 and spray gun 16 to the user and the surrounding devices.

It should further be noted that the spray gun 16 as described above can also be manually operated by a spray operator. In the event that it is manually operated, care must be taken in the set up and design so that the electric potential of the spray gun head 22 cannot reach the operator. A shock to the operator may result if appropriate precautions are not followed and such shock while generally not fatal because of the low micro amperage, however may have very unpleasant consequences and result in harm to the operator. Hence, the spray gun 16, as described above, generally is set up for manual operation such that the wetted front end components and the rear handle components of the spray gun 16 are isolated from each other with a non-conductive material in the form of an electrical insulator member 26. All of the electrical insulating design features prohibit electrical bleed back from the gun 16, as noted above, generally are still also required. In the case of the spray gun 16, the electrical insulator 26, generally is made of a predetermined length non-conductive member. In one contemplated embodiment the electrical insulator 26 generally has a length of approximately six inches and is made of a polyethylene material. This spacer/electrical insulator 26 generally is sufficient to instantly bleed the high voltage down to where the handle 18 is neutral thus removing any possible electrical shock when the gun trigger is released. It should be noted that polyethylene is just one of the many non-conductive materials that may be used for the spacer 26. Generally, as shown in the Figures, a spacer 54 has a cylindrical like shape with an orifice arranged along the center mid point thereof. It should be noted that the spacer 54 can be of any known length, width, cross sectional shape or the like, however in the preferred embodiment a cylindrical shape spacer 54 is used. The cylindrical shape spacer 54 may be arranged with the necessary pins and ports arranged therethrough between the handle 18 of the gun 16 and the spray head 22 of the gun 16. In one contemplated embodiment arranged over the spacer 54 is the electrical insulator member 26 having a predetermined shape and size. The insulator 26 and spacer 54 generally will be made of a polyethylene material but may be made of any other known non-conductive material depending on the design requirements of the spray system 10. In the embodiment shown the insulator member 26 generally connects to the handle 18 via any known fastener 56 and has a channel 58 therein for accepting and receiving the spacer 54 as described above on one end and for connecting the spray head 22 to the opposite end of the electrical insulator member 26. This will ensure that no electricity passes between the head 22 and the handle 18 and between the valving rod 60 and other channels and ports of the spray gun 16, because of the spacer 54, to the person operating the manual spray gun 16. Generally, the electrical insulator 26 has a rectangular shape with two cavities 58 arranged therein, however any other known shape may be used including those that are solid without a cavity and only having an orifice therethrough for allowing the valving rod and other necessary components along with the spacer 54 to be arranged therein. It should be noted that the end opposite of the handle 18 of the electrical insulator 26 generally has a plurality of orifices and notches 62 to allow for connection of the spray head 22 thereto via any known fasteners 56. It should be noted that any other shaped electrical insulator 26 may be used as long as it is capable of being secured between the spray handle 18 of the gun 16 and the spray head 22 of the gun 16 to ensure no voltage is passed therebetween and then onto the user of the spray gun 16. Therefore, any necessary cavities, indentations, channels or the like may be designed into the electrical insulator 26 apart from that shown in the Figures. It should also be noted that any known fasteners may be used to connect the electrical insulator 26 to the handle 18 of the gun 16 and the spray head 22 on the opposite end of the electrical insulator 26 with the valving rod 60 and electrical spacer 54 arranged therebetween.

It should be further noted that the plural component proportioning machine 34 will pump and meter the at least two liquid components 36, 40 do not require modification for this electrostatic processing. Existing proportioners may be utilized in the same configuration as they are currently for processing standard fast set polymers. Generally, the cooling systems that are the basis of the present invention are fast setting, fast curing plural component polymers such as polyurea, polyurethane, phenolic, etc. Such products generally are commercially available and are manufactured by for example Visuron Technologies having the names of Polyarmor, HI-MOD, Warrior and others. These polymers generally are two component liquids but may also include more components, i.e., multi component liquids as long as they, have low viscosity, are very reactive and are 100% solids, i.e., no solvents or water therefore no VOC's. These components typically gel to a solid in approximately four to twenty seconds and are dry to the touch in approximately two to sixty seconds. Many of these fast setting coating systems offer a wide range of physical properties, chemical resistance, abrasion resistance and general performance characteristics. However, it should be noted that before conductive additives are added some of these coatings may exhibit no electrical properties or exhibit such high resistance that they will not accept a charge. Therefore, some may need to be modified with conductive additives to make them capable of accepting the high voltage necessary to spray electrostatically. However, it should be noted that some of the systems as used with the present invention are off the shelf capable of accepting the high voltage necessary to spray electrostatically and do not need any conductive additives added thereto.

However, some of the coatings are compatible with several conductive additives. It is necessary for the coatings, when mixed, to possess a level of resistance to allow them to accept the required charge. However, the coating resistance cannot be too low or the charge will travel backwards through the liquid in the feed hoses and be grounded at the proportioning equipment. Even a very slight leak or bleed is enough to reduce the voltage to the extent that it is insufficient to charge the liquid. Generally, prior art liquid coatings which are solvent based and water based typically have ideal resistances for proper electrostatic spraying. It appears as though the coatings used in the present invention will also perform in the same range as those found in general liquid coatings. It has been shown that a balanced resistance of the two components maximizes the electrostatic properties and enhances the wrap of the dispensed coating around the target device. However, it should be noted that balance is not mandatory, but appears to be the best way known to create the desired wrap around.

If an additive is needed to increase the ability of the materials 36, 40 to accept a charge generally, for the isocyanate side of one contemplated fast set polymer component a propylene carbonate generally is ideal because it exhibits zero resistance and is not reactive with the isocyanates. This material generally is reactive with the amines formulated into the resin or second side of the material. Hence, the propylene carbonate has a stable shelf life in the isocyanates side and when the components are mixed the propylene carbonate is reacted into the backbone of the system. It should be noted that a low dosage of about 2% of the isocyanate side generally works adequately to allow for the material to adequately accept a charge. It should be noted that propylene carbonate is commercially available from several sources and that other alternative additives for the isocyanate side of the component being sprayed are also capable of working.

For the second side or resin side of the fast set polymer system of the present invention several additives appear to work to enhance favorability of the mixed polymer receiving a charge. One of those that appear to work is quartinary ammonium salt. The quartinary ammonium salt generally exhibits stable shelf life in the resin side of the mixture and does not diminish the physical properties of the cured system. It should further be noted that the quartinary ammonium salt has zero electrical resistance and small dosage percentages produce acceptable resistance in the resin side of the component. It should be noted that approximately two to four percent of the resin side generally works to impart the acceptable resistance into the second/resin side component of the spray material. However, it should be noted that generally, the fast set polymers as commercially available through companies such as Visuron Technologies, Inc. are capable of operating and providing the proper electrical properties in the electrostatic spray system when used with the gun and spray system as described above. However, as identified above adding certain additives to both the first component and second component of the two component plural component fast set polymer being used may further increase the ability of the mixed and reacting component to accept an electrical charge thus increasing the cover and wrap around affect on the target apparatus being coated by the system. However, it is not necessary to add these additives into either the first part or second part of the plural component polymer material but may be desirable in certain cases.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An electrostatic spray system for spraying plural component fast set polymers, said system comprising:

a spray gun;

at least two hoses connected to a head of said spray gun;

a proportioner connected to an end of said at least two hoses; and a high voltage generator electrically and pneumatically in communication with said spray gun.

2. The system of claim 1 wherein said spray gun having an electrical insulator arranged between said spray head and a handle thereof.

3. The system of claim 2 wherein said spray head is electrically connected to said generator by a conductor.

4. The system of claim 3 wherein said conductor transfers high voltage to said spray head, said high voltage imparts charge to the polymer material passing through said spray head.

5. The system of claim 1 wherein said proportioner is connected to a first material and to a second material, said materials are combined to create a fast set polymer.

6. The system of claim 1 wherein said hoses are high pressure and capable of operating at up to 3000 psi.

7. The system of claim 2 wherein said hoses having a predetermined portion thereof extending from said spray head electrically non-conductible.

8. The system of claim 7 wherein said predetermined portion is an end of said hoses connected to said spray head.

9. The system of claim 1 wherein said spray gun is pneumatically operated.

10. The system of claim 9 wherein said spray gun having a pneumatic pressure supplied at approximately 120 psi.

11. The system of claim 2 wherein said electrical insulator further comprising a generally cylindrical shaped spacer.

12. The system of claim 11 wherein said insulator is made of a polyethylene material.

13. The system of claim 11 wherein said insulator having a length of approximately six inches.

14. The system of claim 2 further including a head mounting insulation member.

* * * * *